United States Patent [19]

Worthington, Jr.

[11] Patent Number: 5,044,468

[45] Date of Patent: Sep. 3, 1991

[54] LADDER LEVELING DEVICE

[75] Inventor: Charles L. Worthington, Jr., Winchester, Va.

[73] Assignee: Worthington-Kemp, Winchester, Va.

[21] Appl. No.: 611,113

[22] Filed: Nov. 9, 1990

[51] Int. Cl.[5] ..... E06C 7/44

[52] U.S. Cl. ..... 182/202; 248/188.3

[58] Field of Search ..... 182/202, 201, 200; 248/188.3, 188.2, 188.8

[56] References Cited

U.S. PATENT DOCUMENTS

| | | | |
|---|---|---|---|
| 1,223,367 | 4/1917 | Brown . | |
| 1,329,740 | 2/1920 | Barron . | |
| 2,147,052 | 2/1939 | Noone . | |
| 2,327,317 | 8/1943 | Randall . | |
| 2,449,609 | 9/1948 | Linder et al. . | |
| 2,552,941 | 5/1951 | Courtney | 182/202 |
| 2,598,875 | 6/1952 | Anderson | 248/188.3 |
| 3,768,766 | 10/1973 | Bain . | |
| 4,625,424 | 12/1986 | De La Haye . | |
| 4,807,720 | 2/1989 | Kim . | |

FOREIGN PATENT DOCUMENTS

| | | | |
|---|---|---|---|
| 147367 | 7/1952 | Australia | 182/202 |
| 1036485 | 8/1958 | Austria . | |

*Primary Examiner*—Reinaldo P. Machado

*Attorney, Agent, or Firm*—Finnegan, Henderson, Farabow, Garrett & Dunner

[57] ABSTRACT

A ladder leveling device having a pair of hydraulic cylinder/piston units to be secured at the outside lower ends of the ladder side rails in a manner so that the piston rods of the units extend as ladder supports. The working chambers of the units are in fluid communication with each other through a valved passageway which, when open, allow both piston rods to adapt to an irregular supporting surface while the ladder is oriented in a vertical plane. Upon closure of the passageway to isolate the working chambers of the respective units, the piston rods act as rigid extensions of the ladder side rails. Valving of the passageway is effected by a actuating member extending between the side rails in the region of a lower ladder rung so that the member may be depressed to close the passageway by one ascending the ladder in simply stepping on the actuating member.

16 Claims, 2 Drawing Sheets

Fig. 1
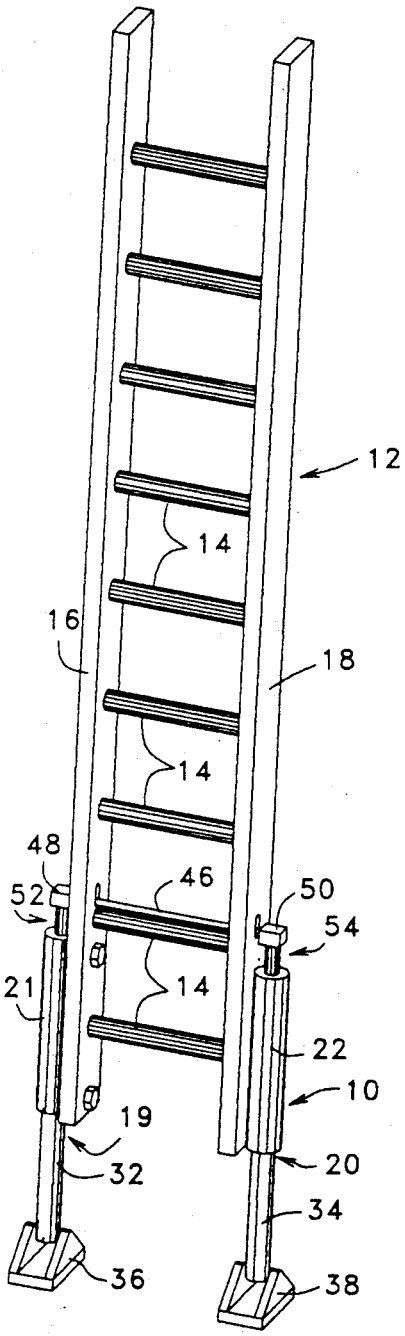
Fig. 2
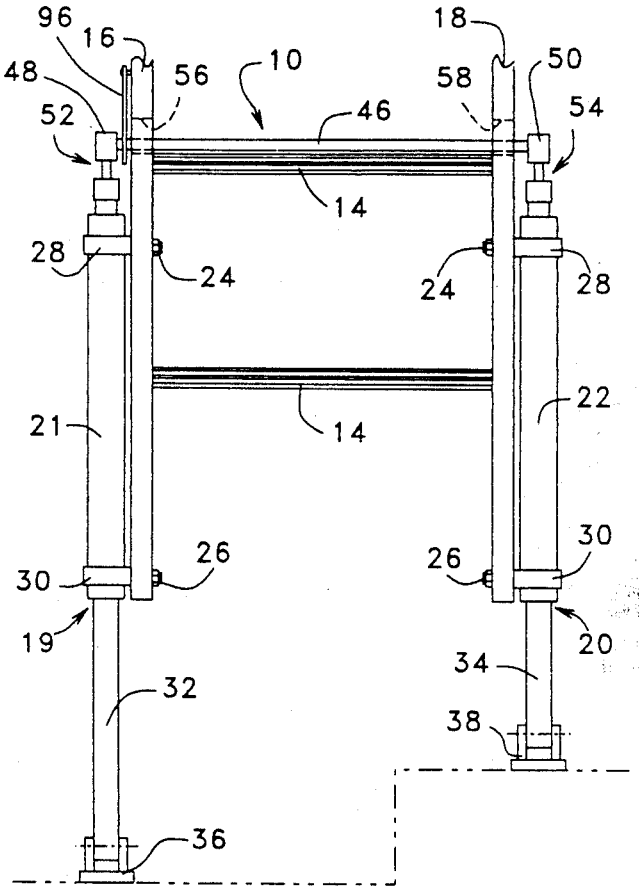
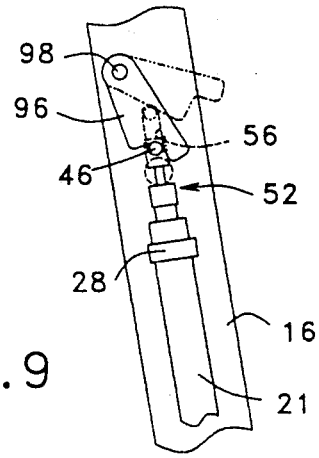
Fig. 9

LADDER LEVELING DEVICE

BACKGROUND OF THE INVENTION

This invention relates to a ladder leveling apparatus and, more particularly, to such a leveling apparatus which assures the stable support of a ladder on an uneven surface with minimal attention on the part of the one using a ladder equipped with the invention.

Ladder leveling devices of the type by which one or both side rails of a multi-rung ladder are made extensible at their lower ends to accommodate support of the ladder on an uneven or irregular surface are exemplified by the disclosures of U.S. Pat. Nos. 1,329,740, 1,223,367, 2,449,609, 2,147,052, 2,327,317 and 4,807,720. The ladder leveling devices of the prior art generally require physical manipulation of the device at the lower end of the ladder independent of orienting the ladder in a vertical plane. The procedure by which the leveling device is adapted to an uneven support involves a substantial measure of trial and error manipulation of both the leveling device and the ladder with which it is assembled. Where a single person is attempting to adjust such devices on rather long ladders, &he procedure for achieving a true stable support can become tedious.

There is a need, therefore, for a ladder leveling device which is self-adjusting to an irregular supporting surface as a result of manipulation only of the ladder so that once the ladder is oriented in a vertical plane, the leveling device on which the ladder is supported is simply fixed to retain the ladder with stability in the properly oriented position.

SUMMARY OF THE PRESENT INVENTION

In accordance with the present invention, the problems associated with ladder leveling devices of the prior art are substantially overcome by the use of an extensible hydraulic cylinder/piston unit at the lower end of each ladder rail and a hydraulic fluid valving arrangement by which the two cylinders are in fluid communication during orientation of the ladder to allow supporting piston rods to extend or contract, as needed to accommodate an irregular supporting surface, and then isolated from each other to provide a fixed stable support for each ladder rail.

An object of the present invention is the provision of a ladder leveling device which will adapt the lower ends of ladder side rails to a supporting surface simply by positioning the ladder in a vertical plane and provide rigid extension of the ladder side rails in use. Another object is the provision of a hydraulic ladder leveler having a pair of interconnected cylinder/piston units and a valve arrangement by which piston rod extensions at the bottom of the ladder side rails may be easily conditioned for both adaptation to a supporting surface and as rigid extensions of the side rails. Still another object is the provision of a valve actuator for a ladder leveler of the type mentioned in which the closure of the valve arrangement is made an incident to a person ascending the ladder, thus insuring safe use of the ladder and leveler. Another object is the provision of such a valve actuator by which valve closure may be detected by a detent type movement of the actuator. Additional objects and advantages of the invention will be set forth in part in the description which follows, and in part will be obvious from the description, or may be learned by the practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a leveling device for a ladder having a plurality of spaced rungs extending between a pair of generally parallel side rails, said device comprising a pair of hydraulic cylinder/piston units adapted to be secured one to each of the lower ends of the ladder side rails, each of said units including an elongated cylinder having top and bottom ends, a piston to establish a working chamber with the upper interior of said cylinder, and a piston rod connected at one end to said piston and extending through the bottom of said cylinder to a ladder support end; means for establishing a closed fluid passageway between said working chambers; valve means for, in a closed position, closing said passageway to isolate said working chambers from each other and for, in an open position, opening said passageway to place said working chambers in fluid communication with each other; and actuating means for selectively moving said valve means to said open or closed position, whereby the ladder support ends self adjust relative to the side rails when the valve means is in said open position and are fixed relative to said rails with stability in the properly oriented position, when the valve means is in the closed position.

The pair of hydraulic cylinder/piston units are secured to lower ends of the ladder side rails so that the piston rods of the respective units extend from the lower ends of the cylinders to a conventional ladder foot. Working chambers at the upper ends of the cylinders are interconnected by a closed fluid passageway including a valve arrangement adjustable between an open condition, in which the working chambers of both cylinders are in fluid communication, and a closed condition in which the cylinders are isolated from each other. The working chambers of both cylinders, the tubular rod and valve associated passageways are preferably filled with hydraulic fluid so that when a ladder equipped with the leveler apparatus of the invention is placed on an uneven surface with the valve arrangement open, the piston rods adjust automatically to the surface on which they are supported. When the ladder is located in a vertical plane, the valve arrangement is closed to isolate the hydraulic fluid in the cylinders above the pistons and provide a rigid extension of the ladder side rails.

The valve arrangement is preferably telescopic in operation so that movement of an actuator, which in the preferred form, is an elongated structural member parallel to and in the vicinity of one of the lower ladder rungs, upwardly by manual lifting will operate to open the valve whereas the valve will be actuated to a closed position by one merely ascending the ladder and stepping on the structural member to depress it. As a result, a minimal amount of attention is required of the user to ensure that the valve arrangement is closed to cause the cylinder/piston units to act as a rigid extension of each ladder side rail.

It is to be understood that both the foregoing general description and the following detailed description are exemplary only and are not restrictive of the invention, as claimed.

The accompanying drawings, which are incorporated in and constitute a part of this specification, illustrate presently preferred embodiments of the invention and, together with the description, serve to explain the principles of the invention.

BRIEF DESCRIPTION OF THE DRAWINGS

FIG. 1 is an isometric view of a ladder equipped with the leveling device of the present invention;

FIG. 2 is a fragmentary front elevation of the lower portion of the ladder shown in FIG. 1;

FIG. 9 is a fragmentary side elevation showing a valve latching arrangement.

DETAILED DESCRIPTION OF THE PREFERRED EMBODIMENTS

Reference will now be made in detail to the present preferred embodiments of the invention, examples which are illustrated in the accompanying drawings. Wherever possible, the same reference numbers will be used throughout the drawings to refer to the same or like parts.

Figure 3:
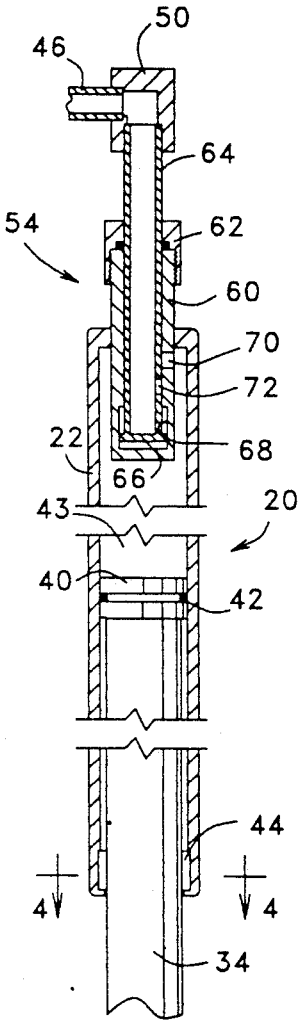
FIG. 3 is a fragmented longitudinal cross-section through a piston/cylinder unit of the invention.
Figure 4:
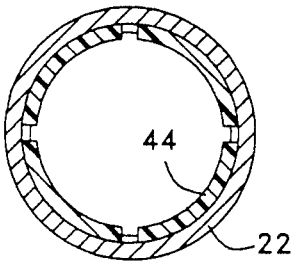
FIG. 4 is an enlarged cross-section on line 4—4 of FIG. 3.

In FIGS. 1-3 of the drawings, an embodiment of the ladder leveler of the present invention is generally designated by the reference numeral 10 and shown assembled to the bottom end of a ladder 12 having a plurality of spaced rungs 14 extending between and fixed at opposite ends to a pair of generally parallel side rails 16 and 18. While the side rails of the ladder 12 are depicted as solid members of rectangular crosssection, other side rail cross-sections conventionally used in ladders of this type may be used, such as for example, channel sections, I-beam sections and the like. Similarly, the configuration of the rungs 14 may be other than cylindrical as shown in FIGS. 1 and 2, this shape being merely representative of several rung configurations conventionally used in ladders.

The ladder leveler 10 includes a pair of elongated hydraulic cylinder/piston units 19 and 20, the cylinders 21 and 22 of which are secured respectively along the outside bottom portions of the ladder side rails 16 and 18 preferably by bolts 24 and 26 positioned near the respective upper and lower ends of each cylinder 21 and 22. The bolts may be anchored in cylinder collars 28 and 30 welded or otherwise suitably secured to the outer periphery of the cylinders 21, 22 near the ends thereof. Piston rods 32 and 34 are telescopically received within the respective cylinders 21 and 22 and extend from the bottom end thereof to pivotal connections at the bottom ends thereof with conventional ladder shoes 36 and 38 in the illustrated embodiment.

The manner in which the piston rods 32 and 34 are received within the respective cylinders 21 and 22 is identical. As shown most clearly in the detailed illustration of the cylinder/piston unit 20 in FIG. 3, the piston rod 34 extends upwardly into the cylinder 22 to a piston 40 having a provision for a sliding seal with the interior surface of the cylinder, specifically an elastomeric O-ring 42 in the illustrated embodiment, the piston establishing the bottom of a working chamber 43 with the upper interior portion of the cylinder 22. At the bottom of the cylinder 22, an internal segmented guide bearing 44 is located to assure concentricity of the rod 34 with the cylinder 22 while facilitating axial movement of these two members. The multi-segmented construction of the guide 44 permits movement of the rod 34 and piston 40 in the cylinder 32 without affecting the pressure of air in the space between the guide 44 and the piston 40. In other words, the spacing between the segments of the guide 44 allows air to enter and escape the annulous between the rod 34 and the inner surface of the cylinder 22.

The working chambers 43 at the upper ends of the cylinders 21 and 22 are in fluid communication with each other by way of a tubular rod 46 which extends between fittings 48 and 50 associated with a valve arrangement including a pair of closure valves generally designated by the reference numerals 52 and 54. As will be apparent from the detailed description of these valves below, actuation of the valves 52 and 54 is dependent on vertical movement of the rod 46. To this end, the ladder side rails 16 and 18 in the illustrated embodiment are provided with slots 56 and 58 through which the rod extends at opposite ends for connection with the fittings 48 and 50 which are located to be generally concentric with the axis of the cylinders 21 and 22 mounted on the outside of the rails 16 and 18.

The closure valves 52 and 54 are identically constructed, the valve 54 being illustrated in FIG. 3 of the drawings. As shown, the valve 54 includes an outer cylindrical body 60 welded or otherwise secured coaxially with the cylinder 22 at the top end thereof. The body 60 extends upwardly to a sealing gland 62 for receiving in telescopic fluid-tight relationship, a moveable tube 64. The tube 64 extends from the fitting 50 downwardly through the body 60 to a closed end-disk portion 66 of slightly larger diameter than the outside diameter of the tube. The disk portion fits within an enlarged portion 68 of the body interior to establish upper and lower limits of travel by the tube 64 in the body 60.

The portion of the body 60 which extends to the interior of the cylinder 22 is provided with an opening or port 70 whereas the tube 64 is provided with a similar port 72. The valve 54 is in a closed position when the ports 70 and 72 are out of registration, as is illustrated in FIG. 3, whereas movement of the tube 64 upwardly will bring the ports 70 and 72 into registration. In this open condition of the valve 54, the interior of the cylinder 22 above the piston 40 is in fluid communication with the interior of the tube 64, the fitting 50 and the tube rod 46. It will be appreciated, moreover, that if the valve 52 on the opposite side of the ladder is in the same open condition, the upper ends of both cylinders 21 and 22 will be in full fluid flow communication.

It is to be noted that the tubular rod 46 is positioned above the second rung 14 of the ladder 12 and is movable from a valveopen position spaced above the rung, down against the top of the rung to a valve-close position. When the tubular rod 46 is spaced upwardly from the second rung 14 of the ladder in its valve open position, both valves 52 and 54 are open so that hydraulic fluid located above the pistons 42 in the cylinders 21 and 22 may pass freely between the cylinders.

In the practice of the invention using the embodiment illustrated in FIG. 1-3, the fluid enclosure established by the working chambers 43 in both cylinders 21 and 22 above the pistons 40, the valve tube 64, the fittings 48 and 50, and the tubular rod 46 is completely filled with incompressible hydraulic fluid. The volume of that fluid enclosure is, moreover, dependent on the quantity of hydraulic fluid contained therein because of the variable axial position of the pistons 40 on each of the piston rods 32 and 34. In this respect, it is to be noted that the strength of the column represented by the piston rods 32, 34 and the cylinders 21, 22 is determined in some measure by the spacing between the piston 40 on the piston rod 34 and the piston rod guide 44 on the cylinders 21, 22. Thus the amount of hydraulic fluid contained in the fluid enclosure is selected so that the pistons 40 will be spaced from the piston rod guides 44 during all conditions of operation.

When the ladder 12 is placed on a level surface in an orientation represented in FIG. 1, and the tubular rod 46 is elevated above the second ladder rung 14 to its valve-open position, both piston rods 32 and 34 will extend from their respective cylinders 21 and 22 by an equal distance. If, on the other hand, the ladder 12 is placed on an uneven support such as that represented by the phantom line in FIG. 2, and the tubular rod 46 remains in its elevated open condition, the piston rods 32 and 34 will assume the position shown in FIG. 2 by movement of the rod 34 into the cylinder 22 and by an equal movement of the rod 32 out of the cylinder 21. In either case, the ladder 12 may be oriented to a truly vertical plane.

When the ladder is so adjusted in relation to a vertical plane, the user may begin to ascend the ladder and upon reaching the second rung may secure the adjusted position of the ladder by stepping on the rod 46 to depress it from its elevated valve-open position down against the top of the second rung 14. Such movement of the rod 46 will cause both valves 52 and 54 to close so that the hydraulic fluid in the respective cylinders 21 and 22 above the pistons 40 is isolated. With the valves in a closed position, the pistons cannot move and the ladder is supported with stability.

The valve organization illustrated in the embodiments of FIGS. 1-3 is desirable from the standpoint that movement of the rod 46 and tubes 64 of both valves 52 and 54 from the upper valve-open position to the valve-close position will result in initially in a contraction of the volume occupied by the incompressible hydraulic fluid. This initial contraction will result in a slight extension of both piston rods 32 and 34 until the ports 70 and 72 move out of registration. At that instant, further downward movement of the tube 64 will occur without changing the volume o hydraulic fluid trapped in the working chambers 43 of the cylinders 21 and 22 and without volumetric change in the hydraulic fluid trapped in the passageway represented by the tube 64 and the rod 46. As a result of this action, a detent-like closure movement is effected when the rod 46 is depressed from its upper valve-open position to its downward position against the second rung, thus providing an indication that the valves 52 and 54 are closed to isolate the hydraulic fluid above the pistons 40 in both cylinders 21 and 22.

It will be appreciated by those skilled in the art that a single valve, located at any point in the fluid passageway between the working chambers of the cylinders would achieve the floating and locking relationship described above. For example, a single valve, with one of a variety of different actuators, could be position along the tubular rod 46. The embodiment shown is preferred since the two valves provides a safety factor, and the preferred actuator effectively ensures that a user will step on the actuator and place the valve into the locking position, before the user ascends the ladder.

Figure 5:
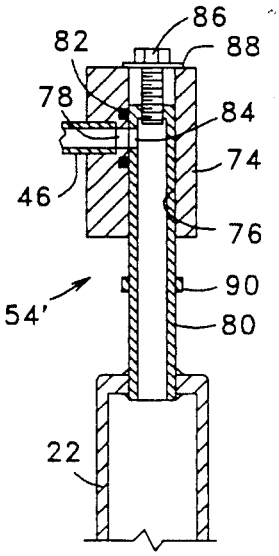
FIG. 5 is a fragmentary longitudinal section similar to FIG. 3 but showing an alternative embodiment of a valve for use in the present invention.

In FIG. 5 of the drawings, an alternative valve embodiment 54' is shown in which no change in the volume of the fluid enclosure filled with hydraulic fluid occurs during valve closure. In this instance, the tubular rod 46 is fixed in a block fitting 74 having a vertical through-bore 76 and a perpendicular port 78 aligned with the rod 46 and opening to the bore 76. A tube 80, welded or otherwise fixed at the top of the cylinder 22, extends axially from the cylinder 22 and is received slidably in the bore 76 of the fitting 74. An 0-ring seal 82 in the fitting 74 and surrounding the port 78 assures a fluid-tight seal about the port 78 between the inside surface of the bore 76 and the outside surface of the tube 80. A port 84 in the tube 80 is located to register with the port 78 in the fitting when the parts are positioned as shown in FIG. 5.

The top end of the tube 80 is closed by a threaded bolt 86 which, with a washer 88, may be adjusted to limit upward travel of the fitting 74 on the tube 80 and establish the position at which the port 78 registers with the port 84. The bolt 86 and the threaded hole in which it is received may also serve as a provision for introducing or removing hydraulic fluid to or from the cylinder 22 and thus the overall fluid enclosure of which the cylinder is a part. A lower limit of travel by the fitting 74 on the tube 80 is provided by a collar 90 fixed to the tube exterior.

Although the valve 54' does not provide the detent action described with respect to the valve 54, it does have the advantage of simplicity, lower cost and a provision for introducing or bleeding hydraulic fluid.

In the described operation of the illustrated embodiment of the ladder leveler 10, it will be apparent that the force applied to the tubular rod 46 to close the valves 52 and 54 requires some measure of resistance to bending or beam strength in the rod 46. In other words, the rod 46 must function as a structural member in addition to serving as a fluid conduit. Although the tubular cross-section of the rod 46 shown in FIG. 13 may achieve adequate beam strength using certain structural materials to form the rod 46, a broader range of materials is acceptable with the alternative constructions shown in FIGS. 6-8 of the drawings.

Figure 7:
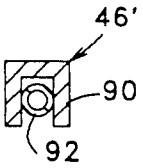
FIG. 7 is a cross-section on line 7—7 of FIG. 6.
Figure 6:
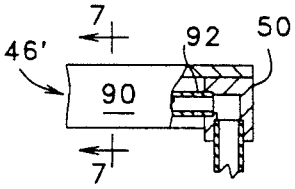
FIG. 6 is a fragmentary front elevation illustrating a modification of the valve actuator of the present invention.

In FIGS. 6 and 7, a structural member which is a variation of the rod 46, and which is designated 46,, is shown to include a channel 90 to extend between the fittings 48 and 50 as these fittings are illustrated in FIGS. 1 and 2. A separate tube 92, which be of relatively low-strength material, extends between the fittings 48 and 50 within the channel 90.

Figure 8:
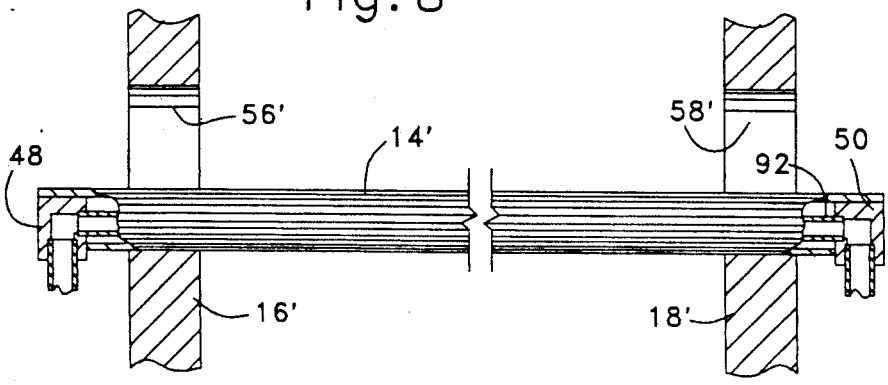
FIG. 8 is a fragmentary cross-section illustrating a further alternative embodiment of the valve actuator of the present invention.

In FIG. 8, the structural member represented by the tubular rod 46 is replaced by a ladder rung 14' which extends through enlarged slots 56' and 58' in the ladder side rails 16' and 18'. The rung 14' differs from the other rungs 14 of the ladder 12 only in that it is elongated and constructed to be fixed at its ends to the block fittings 48 and 50 of the valves 52 and 54. As in the embodiment of FIGS. 6 and 7, the tube 92 extends through the rung 14' to establish fluid communication between the fittings 48 and 50. By positioning the slots 56' and 58' so that the rung 14' assumes a normal rung spacing while resting on the bottom of the slots 56' and 58' the rung 14' functions both as a ladder rung and as an actuator rod for the valves 52 and 54.

It is to be noted that in both of the exemplary valve embodiments shown in FIGS. 3 and 5, the radially ported telescopic arrangements of tubular members will result in the valves remaining in a closed condition irrespective of fluid pressure in the closed fluid system. As an added measure of safety to ensure against accidental opening of the fluid passageway between the working chambers 43 in the cylinders 21 and 22 after they have been isolated, a valve latching provision is made for at least one of the valves 52, 54 on opposite side rails 16, 18 of the ladder 12.

As shown in FIGS. 2 and 9, a latch plate 92 is pivotally supported over the rod 46 by a pin 98 in the ladder side rail 16. The plate is formed with a downwardly facing shoulder so that when the rod 46 is depressed to close the valves 52 and 54, the plate 92 will swing by gravity to the solid line position shown in FIG. 9. To open the valves, the plate must first be lifted manually to the phantom line position shown and the rod 46 then lifted to open the valves. The latch plate 92 may be used on both ends of the rod and may be adapted to the various shapes of actuators shown in FIGS. 6–8.

The present invention can be applied as a kit to be added to existing ladders. To apply the kit to a ladder, the user needs merely to drill holes in the ladder for acceptance of the bolts 24 and 26 and place elongated slots in the ladder for acceptance of the tubular rod 46. The present invention can also be incorporated into new ladders, in either the manner shown in the drawings or in an equivalent manner.

It will be apparent to those skilled in the art from the foregoing description, the accompanying drawings and in the practice of the invention that modifications and variations can be made in the ladder leveler of the present invention without departing from the scope or spirit of the invention. It is intended, therefore, that the embodiments described and illustrated herein be considered as exemplary only, and that the true spirit and scope of the invention be determined from the following claims.

What is claimed is:

1. A leveling device for a ladder having a plurality of spaced rungs extending between a pair of generally parallel side rails, said device comprising:

a pair of hydraulic cylinder/piston units adapted to be secured one to each of the lower ends of the ladder side rails, each of said units including an elongated cylinder having top and bottom ends, a piston to establish a working chamber with the upper interior of said cylinder, and a piston rod connected at one end to said piston and extending through the bottom of said cylinder to a ladder support end;

means for establishing a closed fluid passageway between said working chambers;

valve means for, in a closed position, closing said passageway to isolate said working chambers from each other and for, in an open position, opening said passageway to place said working chambers in fluid communication with each other; and actuating means for selectively moving said valve means to said open or closed position, whereby the ladder support ends self adjust relative to the side rails when the valve means is in said open position and are fixed relative to said rails with stability in the properly oriented position, when the valve means is in the closed position, said actuating means being located in the region of a lower rung of the ladder and movable between an elevated valve-open position and a depressed valve-close position, whereby said valve means is closed by stepping on said actuating means in ascending the ladder.

2. The leveling device of claim 1 wherein said actuating means comprises an elongated structural member extending generally parallel to the ladder rungs.

3. The leveling device of claim 2 wherein said structural member comprises a tubular rod and is included in said means to establish said fluid passageway.

4. The leveling device of claim 2 wherein said structural member comprises a beam-like component and wherein said fluid passageway comprises a tube fixed to said beam-like component.

5. The leveling device of claim 2 wherein said structural member comprises a movable ladder rung, the side rails of the ladder having slots for supporting said movable ladder rung.

6. A leveling device for a ladder having a plurality of spaced rungs extending between a pair of generally parallel side rails, said device comprising:

a pair of hydraulic cylinder/piston units adapted to be secured one to each of the lower ends of the ladder side rails, each of said units including an elongated cylinder having top and bottom ends, a piston to establish a working chamber with the upper interior of said cylinder, and a piston rod connected at one end to said piston and extending through the bottom of said cylinder to a ladder support end;

means for establishing a closed fluid passageway between said working chambers;

valve means for, in a closed position, closing said passageway to isolate said working chambers from each other and for, in an open position, opening said passageway to place said working chambers in fluid communication with each other; and actuating means for selectively moving said valve means to said open or closed position, whereby the ladder support ends self adjust relative to the side rails when the valve means is in said open position and are fixed relative to said rails with stability in the properly oriented position, when the valve means is in the closed position;

said valve means comprising a tubular body coaxially fixed to the top of at least one of said cylinders and a valve member movable by said actuating means along the axis of said tubular body, said tubular body being included in said means to establish said fluid passageway.

7. The leveling device of claim 6 wherein said valve means comprises a tubular body and a valve member at the top of both said cylinders and wherein said actuating means comprises an elongated structural member extending between said valve means.

8. The leveling device of claim 6 wherein said tubular body and said valve member include radial ports which register one with the other in an elevated position of said valve member to provide an open valve condition and which provide a closed valve condition by movement of said valve member to a depressed position.

9. The leveling device of claim 8 wherein said tubular valve member is located within said tubular valve body.

10. The leveling device of claim 9 wherein said tubular body and said tubular valve member include closed bottom ends to establish a space isolated from said closed fluid passageway and means to limit travel of said valve member between said elevated position and said depressed position.

11. The leveling device of claim 8 wherein said tubular valve member is located on the exterior of said tubular valve body.

12. The leveling device of claim 11 wherein said valve member comprises a fitting having a through bore for receiving said tubular body, said body having a closed top end.

13. The leveling device of claim 12 including a threaded bolt extending through said closed top end, said bolt defining a stop limiting upward movement of said fitting on said body.

14. A leveling device for a ladder having a plurality of spaced rungs extending between a pair of generally parallel side rails, said device comprising:

a pair of hydraulic cylinder/piston units adapted to be secured one to each of the lower ends of the ladder side rails, each of said units including an elongated cylinder having top and bottom ends, a piston to establish a working chamber with the upper interior of said cylinder, and a piston rod connected at one end to said piston and extending through the bottom of said cylinder to a ladder support end;

means for establishing a closed fluid passageway between said working chambers;

valve means for, in a closed position, closing said passageway to isolate said working chambers from each other and for, in an open position, opening said passageway to place said working chambers in fluid communication with each other; and actuating means for selectively moving said valve means to said open or closed position, whereby the ladder support ends self adjust relative to the side rails when the valve means is in said open position and are fixed relative to said rails with stability in the properly oriented position, when the valve means is in the closed position, said actuating means comprising an elongated structural member extending generally parallel to the ladder rungs and located in the region of a lower rung of the ladder for movement between an elevated valve-open position and a depressed valve-close position, whereby said valve means is closed by stepping on said actuating means in ascending the ladder.

15. The leveling device of claim 14 wherein said valve means comprises a tubular body coaxially fixed to the top of at least one of said cylinders and a valve member movable by said actuating means along the axis of said tubular body, said tubular body being included in said means to establish said fluid passageway.

16. The ladder leveling device of claim 14 wherein said cylinder/piston units are enacted to be secured to the outside of the lower ends of the ladder side rails.

* * * * *